US007950204B2

(12) United States Patent
Dandl et al.

(10) Patent No.: US 7,950,204 B2
(45) Date of Patent: May 31, 2011

(54) METHOD AND APPARATUS FOR SEPARATING FOIL LAYERS AS WELL AS LINE FOR INSERT WELDING

(75) Inventors: Andreas Dandl, Laufen (DE); Dieter Kamml, Ainring (DE); Marco Hobelsberger, Saaldorf-Surheim (DE); Heinz Hinterseer, Freilassing (DE); Martin Klein, Hallein (AT)

(73) Assignee: KIEFEL GmbH, Freilassing (DE)

( * ) Notice: Subject to any disclaimer, the term of this patent is extended or adjusted under 35 U.S.C. 154(b) by 117 days.

(21) Appl. No.: 12/009,119

(22) Filed: Jan. 16, 2008

(65) Prior Publication Data

US 2009/0000255 A1 Jan. 1, 2009

(30) Foreign Application Priority Data

Jan. 17, 2007 (DE) ..... 10 2007 003 342

(51) Int. Cl.
*B65B 43/00* (2006.01)

(52) U.S. Cl. ..... 53/452; 53/492; 53/384.1; 53/558; 493/354; 493/372

(58) Field of Classification Search ..... 493/341, 493/353, 354, 363, 364, 372, 373; 53/492, 53/449, 456, 457, 172, 567, 370, 381.2, 381.3, 53/384.1, 452, 455, 558, 67, 5
See application file for complete search history.

(56) References Cited

U.S. PATENT DOCUMENTS

| | | | | | |
|---|---|---|---|---|---|
| 3,254,468 | A * | 6/1966 | Lerner | 53/459 |
| 3,455,214 | A * | 7/1969 | Lindh et al. | 493/352 |
| 3,533,331 | A * | 10/1970 | Kugler | 493/194 |
| 3,730,411 | A * | 5/1973 | Brockmuller | 225/100 |
| 4,074,961 | A * | 2/1978 | Reil | 425/112 |
| 4,285,681 | A * | 8/1981 | Walitalo et al. | 493/194 |
| 4,334,399 | A * | 6/1982 | Onishi | 53/69 |
| 4,360,996 | A * | 11/1982 | Rutter | 53/469 |
| 4,393,640 | A * | 7/1983 | Cole et al. | 53/69 |
| 4,835,948 | A * | 6/1989 | Humphrey | 53/567 |
| 5,074,951 | A * | 12/1991 | Banco et al. | 156/515 |
| 5,232,430 | A * | 8/1993 | Nitsch | 493/341 |
| 5,407,116 | A * | 4/1995 | Nishishita et al. | 225/2 |
| 5,417,639 | A * | 5/1995 | Cronauer | 493/223 |
| 6,038,950 | A * | 3/2000 | Ogawa et al. | 83/54 |
| 6,050,063 | A * | 4/2000 | Ford et al. | 53/458 |
| 6,094,895 | A * | 8/2000 | Ravizza | 53/567 |
| 6,267,714 | B1 * | 7/2001 | Wild et al. | 493/11 |
| 6,269,614 | B1 * | 8/2001 | Spina et al. | 53/492 |
| 6,775,959 | B1 * | 8/2004 | Lasson | 53/492 |
| 6,945,695 | B2 * | 9/2005 | Rabiea | 383/37 |
| 7,654,064 | B2 * | 2/2010 | Riccardi et al. | 53/469 |

* cited by examiner

*Primary Examiner* — Paul R Durand
(74) *Attorney, Agent, or Firm* — Collard & Roe, P.C.

(57) ABSTRACT

The invention relates to a method and an apparatus for separating foil layers in a foil processing line, the foil layers being caused to move relative to each other, and to a method and an apparatus for further processing the separated foils for manufacturing a product in which an insert is interposed between two foils.

23 Claims, 2 Drawing Sheets

Figure 1:
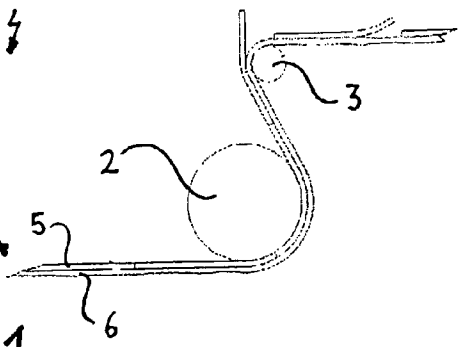

METHOD AND APPARATUS FOR SEPARATING FOIL LAYERS AS WELL AS LINE FOR INSERT WELDING

The invention relates to a method and an apparatus for separating foil layers in a foil processing line, as well as to such a line.

Various methods for separating foils are known. Two main method groups can be distinguished.

On the one side, the foil layers are separated by objects introduced between them. Foil layers may for example be separated by fingers being passed between the layers, or the foils are being passed through a separating plate.

On the other side, foils may be separated by taking hold of them and pulling them apart using tongs or vacuum strips.

In both cases, separation becomes increasingly difficult as the foils become thinner and as the adhesion force between the foil layers increases.

It is the object of the present invention to provide an improved method of separating foil layers in a foil processing line.

In accordance with a first aspect of the invention, the solution to this object is a method of separating foil layers wherein the foil layers are caused to move relative to each other.

By relatively moving the foil layers, air penetrates between them, causing them to separate. Foil separation relying on relative movement may also be used for very thin foils without damage to them. Separation of multiple layer foils is also possible without the discrete layers risking damage like in a mechanical separation with a sharp wedge. The air penetrating between the foil layers through the relative movement results in secure opening of the foils in the next processing step, for example through vacuum grippers. Accordingly, foils separated by relative movement are easy to grasp and open, which allows for easier further processing.

An advantage is obtained if, in a preceding step, a transverse line of weakness is made in at least one foil layer. If the foils are moved relative to each other thereafter, the weakest area breaks when appropriately formed so that air is allowed to penetrate between the foil layers in this area defined by the cut.

In a step prior to separating, at least one foil layer can be cut. Then, the foil layers are caused to relatively move and air is allowed to penetrate between them through this cut.

Weakening or cutting at least one foil layer completely through may be performed using various cutting techniques. The cut may be a pulling cut, a pendulum cut, a parallel cut or may be performed using a rotating blade. Punching is also possible. Other alternatives for performing the partial or complete separation are a laser, ultrasound or a water jet. Various separating methods are advantageous, depending on the kind of the foil, its thickness and the cutting accuracy required.

Advantageously, the foil layers are fixed on at least one side when being separated. As a result, the foils cannot slide out of place uncontrollably under the action of shear forces generated for causing the various foils to relatively move.

In order to achieve the same advantage, the foil layers may be partially welded already before separation. Partial welding prevents the foil layers from sliding out of place, separation through relative movement remaining possible for the non welded part.

The relative movement can be realized through various technical solutions. Generally, only one of these solutions is being used in one method although it may also happen that cumulative use is advantageous.

First, a relative movement may be achieved by bending the foil over a roll. If the foil is bent about the radius of the roll, the foil layers open at the place where the foil has been cut or cut through and air penetrates between the webs of foil.

Second, the relative movement can be enforced by an eccentric. By stretching the bottom foil a tensile strain is generated, which causes the webs of foil to detach from each other.

The same advantageous principle is taken advantage of in another technical solution: the use of a wedge. Here also, a tensile strain is generated by stretching the bottom foil, said strain causing the foils to separate.

Other technical solutions relying on the same principle are a roll or a foil level displacement device.

Third, the relative movement may occur through pulling. A tensile strain is thereby generated using suited holding apparatus in the direction of the foil, said strain causing the webs of foil to detach from each other. It is contemplated both to have one foil layer fixed and the other one pulled and to have both foils pulled a different distance or at different speeds.

In a subsequent step of the foil separating method, at least one additional foil layer can be cut. As a result, the cut out foils are definitively separated from each other.

Another advantage is achieved if only the outer side of the two webs of foil is contacted during separation of the foil layers. Thus, the foil area between the foil webs will not be contaminated. This may be particularly desirable in the production of medical products under cleanroom conditions.

The object of the present invention is also achieved by an apparatus for separating foils using a cutting device and a separating apparatus, more specifically for carrying out the method described herein above, said separating apparatus causing the foil layers to move relative to each other.

The relative movement of the foil layers causes air to penetrate between the foil layers. This allows for subsequent process secure separation of the foil layers by means of mechanical grippers or vacuum grippers. In addition thereto, separation of the foil webs through relative movement allows for damage-free separation of thin foils and separation of multiple layer foils without damage to the layers.

It is advantageous if the apparatus comprises a blade or a laser. Using a cutting or cut-through method adapted to the foil material, the foil may be selectively separated at the cut.

Another advantage is that the apparatus comprises a device for holding a foil layer down. One foil layer may thus be fixed whilst the other foil layer is caused to move relative to the first foil layer.

A series of various separating apparatus, which may be provided as an alternative or in addition thereto, may be distinguished.

The separating apparatus may comprise a roll for deflecting two foil layers. The relative movement is hereby generated by stretching the foil about the radius of the roll.

The separating apparatus may further comprise a wedge and/or an eccentric. In these two cases as well as when a roll is being used or when the foil levels are being displaced, the relative movement is generated by stretching the bottom foil.

Finally, the separating apparatus may comprise a pulling apparatus. With suited holding apparatus in the foil direction, a foil may be retained whilst the other one is pulled relative thereto.

The object is also achieved by a line for insert welding, with an apparatus for separating foils in the manner described herein above and with a welding device, the foils being opened by grippers after separation. Since the foil layers have been separated beforehand, the process of opening for introducing the insert is possible and secure.

After separation, the foils may also be opened by vacuum suction cups. This is particularly advantageous with stiffer foils that are difficult to grasp mechanically.

In an advantageous implementation, opposing vacuum suction cups are offset. For, if two suction cups are attached one above the other, air is squeezed out from the already opened foil so that a strong adherence builds up between the foils. Then, subsequent opening is no longer process secure.

Further, the object is achieved by a method of manufacturing a product in which an insert is placed between two foils, a separating method of the type mentioned herein above being used prior to introducing the insert, the already separated foils being opened with a gripper or a vacuum suction cup and the insert being introduced between the foils. This method allows for process secure opening for introducing the insert.

Advantageously, the foils are welded together after the insert has been introduced. As a result, the foil layers are connected fixedly to the insert.

The invention will be best understood from the following detailed description of several exemplary embodiments when read in conjunction with the accompanying drawings.

Figure 2:
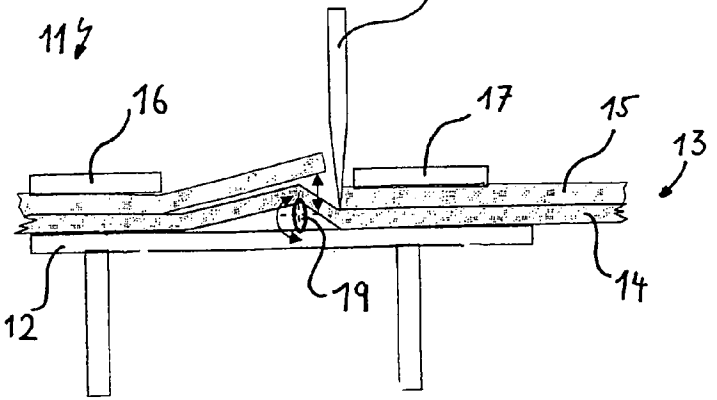
Figure 3:
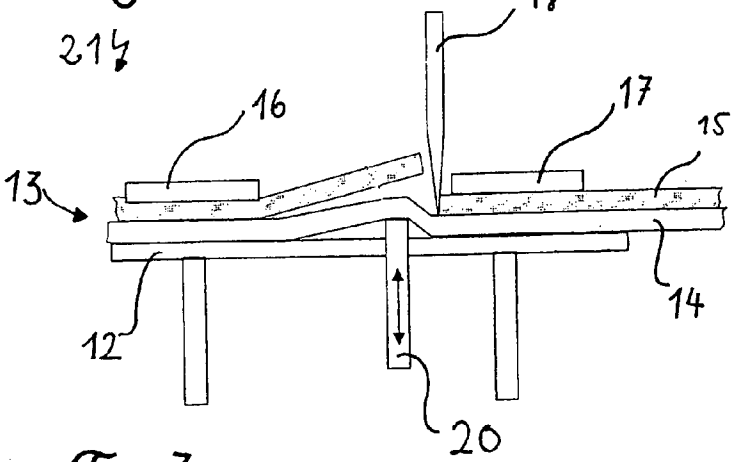
Figure 4:
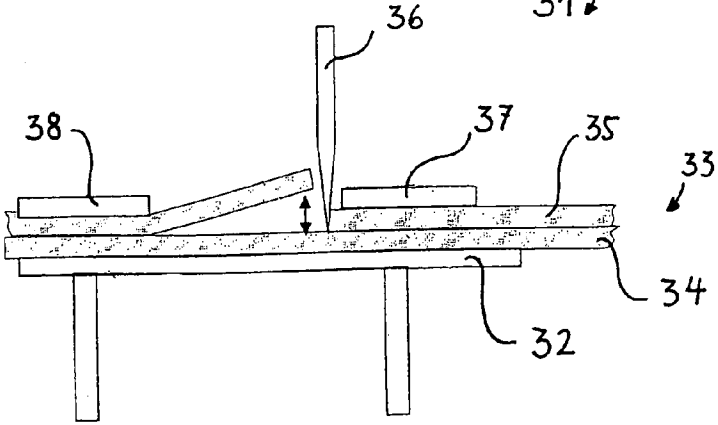
Figure 5:
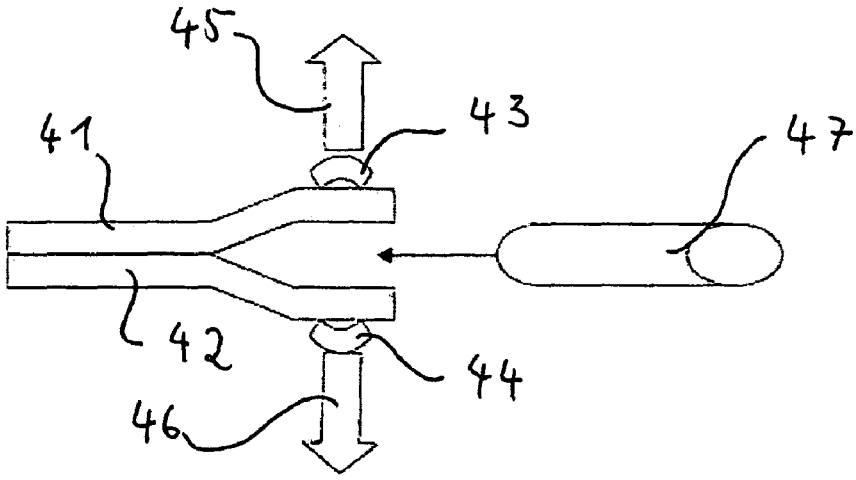
Figure 6:
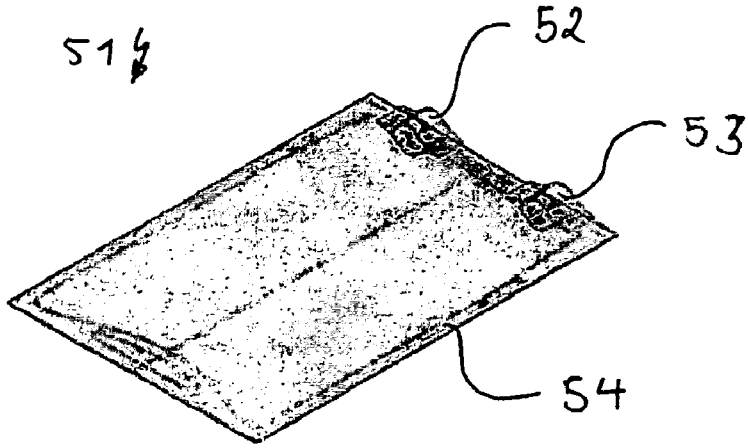

In said drawings:

FIG. 1 is a schematic sectional view of an apparatus for generating a relative movement by bending about a roll, FIG. 2 is a schematic sectional view of an apparatus for generating a relative movement using an eccentric, FIG. 3 is a schematic sectional view of an apparatus for generating a relative movement with the help of a wedge, FIG. 4 is a schematic sectional view of an apparatus for generating a relative movement by pulling, FIG. 5 is a schematic view of the process of inserting an insert, and FIG. 6 is a schematic view of a final product in the form of an infusion bag.

A first exemplary embodiment is a method of separating foil layers in a foil processing line, said foil layers being caused to move relative to each other by means of a separating apparatus. This method may for example be used for manufacturing infusion bags.

The method is suited for double wound foils, i.e., for two foil layers open on the side, for laterally cut tubular foils or for a closed tubular foil.

In a first step, a foil layer is cut or cut through using a cross cutter. In the next step of what is referred to as perimeter welding, the foil layers are welded together and then cooled. The perimeter of the layers is however only welded on ¾ of its length for subsequent opening and introduction of an insert.

Alternatively, the cut may be made after perimeter welding has been performed if the distance between the cut and the weld seam is at least 1 mm.

The foil layers will be actually separated in the next step only. A separating apparatus 1 in FIG. 1 for generating a relative movement consists substantially of two rolls 2, 3.

A foil 4 consists of an upper foil layer 5 and of a lower foil layer 6. The foil 4 coming from the roll 2 is deflected toward roll 3 so that the foil is so strongly bent over the radius of the roll 3 that the upper foil layer 5 is separated from the lower foil layer 6 and folds open toward the top.

As a result of the welding performed on part of the perimeter in the previous step, the upper foil layer 5 folds back onto the lower foil layer 6 when the foil 4 advances further. Only then will the lower foil layer 6 also be cut through.

In the next step, the foil is opened through vacuum suction cups. For a foil of about 10 cm in length, a suction cup array having two suction cups spaced 25 mm apart in the lower portion and at least three suction cups also spaced 25 mm apart in the upper portion is suited. Said suction cups should not be mounted so as to face each other. If two suction cups are mounted one above the other, air is squeezed out of the already opened foil so that strong adherence builds up between the foils. Sometimes, subsequent opening is no longer process secure.

The inserts may then be introduced between the thus separated foil layers 5, 6 and be welded together therewith.

In a testing facility of the inventors, this method allows for about 14 cycles a minute.

The other exemplary embodiment of a separating apparatus 11 relying on relative movement as shown in FIG. 2, substantially consists of a substructure for a foil 13 consisting of a lower foil layer 14 and of an upper foil layer 15 to rest on, of two devices 16, 17 for holding the layers down as well as of a blade 18 and of the eccentric 19.

By rotating the eccentric 19, the lower foil layer 14 is raised and stretched in operation so that the upper foil layer 15 is raised and separated after having been cut with the blade 18.

As shown in FIG. 3, the eccentric 19 shown in FIG. 2 may be replaced by the wedge 20, with the rest of the construction of a foil separating apparatus 21 remaining unchanged.

The other exemplary embodiment shown in FIG. 4 of an apparatus 31 for generating the relative movement substantially consists of a substructure 32 for a foil 33 consisting of a lower foil layer 34 and of an upper foil layer 35 to rest on as well as of a cutting apparatus 36 and of an apparatus 37 for holding the foil down as well as of a pulling apparatus 38. After the foil 33 has been cut with the cutting apparatus 36, it is fixed with the apparatus 37 for holding the foil down whilst the foil 33 is being pulled with the pulling apparatus 38. The thus generated relative movement in the foil transport direction, meaning from the right to the left in the drawing, causes the lower foil layer 34 to separate from the upper foil layer 35. Before the foil 33 is transported away, the lower foil layer 34 may also be cut through by changing the cutting depth of the cutting apparatus 36.

In FIG. 5, two foil layers 41,42 are held by a vacuum suction cup 43,44, and are pulled in the opposite directions according to arrows 45,46. In this way, the already pre-separated foil layers 41 and 42 are opened and an insert 47 can be placed between the two foil layers 41,42.

In FIG. 6 for the infusion bag 51 there are two inserts 52,53 placed between the two previously separated foil layers. At a seam 54 of the infusion bag, the two foil layers are welded together. By that a bag 51 is formed and the two inserts 52,53 are permanently fixed.

The invention claimed is:

1. A method for manufacturing a product comprising the steps of:

(a) providing first and second foil layers in a foil processing line;

(b) moving the foil layers relative to each other to separate the first foil layer from the second foil layer in the foil processing line in the proximity of an opening in the first foil layer, the first foil layer folding open away from the second foil layer;

(c) opening the first and second foil layers following separation with a gripper or a vacuum suction cup; and (d) introducing an insert between the first and second foil layers.

2. The method as set forth in claim 1, wherein the first and second foil layers are welded after the insert has been inserted.

3. A method of separating foil layers in a foil processing line comprising the steps of:

(a) providing first and second foil layers in a foil processing line, (b) forming an opening only in the first foil layer; and (c) moving the foil layers relative to each other to separate the first foil layer from the second foil layer in the foil processing line in the proximity of the opening in the first foil layer, the first foil layer folding open away from the second foil layer.

4. The method as set forth in claim 3, wherein the opening results from a transverse line of weakness made in the first foil layer.

5. The method as set forth in claim 3, wherein the opening results from a cut made in the first foil layer.

6. The method as set forth in claim 3, wherein a cut is made with a blade or a laser.

7. The method as set forth in claim 3, wherein the foil layers are fixed on at least one side during separation.

8. The method as set forth in claim 3, wherein the foil layers are partially welded together already before separation.

9. The method as set forth in claim 3, wherein relative movement is caused to occur by bending the first and second foil layers over a roll.

10. The method as set forth in claim 3, wherein relative movement is caused to occur through pulling.

11. The method as set forth in claim 3, wherein contact only occurs with a respective outer side of the first and second foil layers.

12. The method as set forth in claim 3, wherein at least one additional foil layer is cut in a subsequent step.

13. A method of separating foil layers in a foil processing line comprising the steps of:

(a) providing first and second foil layers in a foil processing line; and (b) moving the foil layers relative to each other to separate the first foil layer from the second foil layer in the foil processing line in the proximity of an opening in the first foil layer, the first foil layer folding open away from the second foil layer;

wherein relative movement is caused to occur through an eccentric.

14. A method of separating foil layers in a foil processing line comprising the steps of:

(a) providing first and second foil layers in a foil processing line; and (b) moving the foil layers relative to each other to separate the first foil layer from the second foil layer in the foil processing line in the proximity of an opening in the first foil layer, the first foil layer folding open away from the second foil layer;

wherein relative movement is caused to occur through a wedge.

15. An apparatus for separating foil layers in a foil processing line comprising:

(a) a cutting device; and (b) a separating apparatus comprising a wedge;

wherein said separating apparatus causes first and second foil layers in a foil processing line to move relative to each other to separate the first foil layer from the second foil layer in the foil processing line in the proximity of an opening in the first foil layer, the first foil layer folding open away from the second foil layer.

16. An apparatus for separating foil layers in a foil processing line comprising:

(a) a cutting device; and (b) a separating apparatus comprising an eccentric;

wherein said separating apparatus causes first and second foil layers in a foil processing line to move relative to each other to separate the first foil layer from the second foil layer in the foil processing line in the proximity of an opening in the first foil layer, the first foil layer folding open away from the second foil layer.

17. The apparatus as set forth in claim 16, wherein said cutting device comprises a blade or a laser.

18. The apparatus as set forth in claim 16, wherein said separating apparatus comprises a device for holding a foil layer down.

19. The apparatus as set forth in claim 16, wherein said separating apparatus comprises a roll for deflecting the first and second foil layers.

20. The apparatus as set forth in claim 16, wherein said separating apparatus comprises a pulling device.

21. A line for insert welding, with an apparatus as set forth in claim 16 and with a welding device, wherein the first and second foil layers open after separation under the action of grippers.

22. The line as set forth in claim 21, wherein the first and second foil layers open after separation under the action of vacuum suction cups.

23. The line as set forth in claim 22, wherein the vacuum suction cups are oppositely disposed offset relative to each other.

* * * * *